US007533666B2

(12) United States Patent
Hosoi et al.

(10) Patent No.: US 7,533,666 B2
(45) Date of Patent: May 19, 2009

(54) BUILT-IN TYPE HEATING COOKING DEVICE

(75) Inventors: Koichi Hosoi, Kobe (JP); Kazuichi Okada, Kobe (JP); Satoru Kodama, Shiki-gun (JP)

(73) Assignee: Panasonic Corporation, Osaka (JP)

( * ) Notice: Subject to any disclaimer, the term of this patent is extended or adjusted under 35 U.S.C. 154(b) by 640 days.

(21) Appl. No.: 10/535,221

(22) PCT Filed: Oct. 20, 2004

(86) PCT No.: PCT/JP2004/015472

§ 371 (c)(1),
(2), (4) Date: May 17, 2005

(87) PCT Pub. No.: WO2005/088199

PCT Pub. Date: Sep. 22, 2005

(65) Prior Publication Data

US 2006/0144388 A1 Jul. 6, 2006

(30) Foreign Application Priority Data

Mar. 16, 2004 (JP) ..... 2004-074262

(51) Int. Cl.
*F24C 3/00* (2006.01)
*F24C 15/10* (2006.01)

(52) U.S. Cl. ..... 126/214 A; 126/39 H; 126/37 A; 126/39 K; 126/299 D

(58) Field of Classification Search ..... 126/214 A, 126/39 H, 37 A, 39 K, 21 A, 21 R, 299 D; 219/623, 452.12; D7/367
See application file for complete search history.

(56) References Cited

U.S. PATENT DOCUMENTS 3,947,652 A * 3/1976 Cobb
4,549,052 A 10/1985 Simon

FOREIGN PATENT DOCUMENTS

EP 0 180 458 A 5/1986
EP 0 675 672 A 10/1995

(Continued)

OTHER PUBLICATIONS

Japanese Search Report for PCT/JP2004/015472, dated Feb. 1 2005.

(Continued)

*Primary Examiner*—Alfred Basichas
(74) *Attorney, Agent, or Firm*—RatnerPrestia

(57) ABSTRACT

A built-in heating cooker which features both good cooling performance and effective countermeasures against spilled liquids by preventing ingress of water into the cooker body with a simple ventilation structure. This built-in cooker comprises a top plate where a pot and the like are placed, a support for supporting the top plate from underneath, a top frame covering the edge of the top plate and a frame constituting the cooker body. The support has a cooker-supporting face for supporting the cooker, and this is positioned outside of the top plate-supporting face. A first opening is provided on at least one side wall provided between the top plate-supporting face and the cooker-supporting face. A second opening is provided on a frame in a position corresponding to the first opening.

16 Claims, 9 Drawing Sheets

FOREIGN PATENT DOCUMENTS

| | | | |
|---|---|---|---|
| JP | 57-145296 | | 9/1982 |
| JP | 57 145296 | U | 9/1982 |
| JP | 01-095483 | A | 4/1989 |
| JP | 02 234384 | A | 9/1990 |
| JP | 03-122990 | A | 5/1991 |
| JP | 11-354263 | A | 12/1999 |
| WO | WO 83/03736 | A | 10/1983 |

OTHER PUBLICATIONS

English translation of Form PCT/ISA/210.
Supplemental European Search Report dated Apr. 11, 2008 for EP 04 79 2638.

* cited by examiner

BUILT-IN TYPE HEATING COOKING DEVICE

THIS APPLICATION IS A U.S. NATIONAL PHASE APPLICATION OF PCT INTERNATIONAL APPLICATION PCT/JP2004/015472.

TECHNICAL FIELD

The present invention relates to the ventilation structure of built-in heating cookers.

BACKGROUND ART

In the ventilation structure of a conventional built-in heating cooker (cooker), an air inlet is typically provided at the front bottom of the cooker and an air outlet is provided at the side rear of the cooker. In addition, a cooker-supporting face is located further in toward the cooker than the air outlet.

The Japanese Patent Laid-open Application No. H11-354263 discloses one of this type of cookers.

FIG. 11 shows the ventilation structure of a conventional cooker. As shown in FIG. 11, top plate 2 configured typically with a ceramic plate is placed and bonded on support 1 constituting the top part of the cooker body. Opening 3 (air outlet) for allowing air from inside the cooker to escape is provided at the side rear of support 1. Cooker-supporting face 4 of support 1 for supporting the cooker itself is formed further inward of the cooker from opening 3. Frame 5 is configured further inner than cooker-supporting face 4, and disposed on cabinet 6. Wall 8 to prevent ingress of spilled liquids is provided inside opening 3 (air outlet) on flange 7 of frame 5. Cooling air for cooling the cooker's internal space passes through between support 1 and flange 7, and support 1 and wall 8, then exits from opening 3. However, in this conventional structure, the small distance between opening 3 (air outlet) and the cooker's internal space is likely to allow spilled liquids from outside enter inside the cooker body. Accordingly, provision of wall 8 is necessary for blocking spilled liquids.

On the other hand, wall 8 cannot be simply provided. A complicated layout, such as alternately disposed multiple walls, is needed for securing cooling performance. As a result, the top part cannot be made thin. In other words, it is difficult to provide both reliable protection against spilled liquids (countermeasures against spilled liquids) and good cooling performance.

Still more, since an edge of top plate 2 is exposed, the edge needs to be treated (e.g., by chamfering) to protect the user from injury while using the cooker.

More specifically, since the edge is exposed as a component, an extra work of edge treatment needs to be provided, and the area of top plate 2 itself cannot be made broader.

Still more, the space between top plate 2 and flange 7 is the narrowest of the necessary spaces (under top plate 2) for maintaining cooling performance, and is also the space which needs to be secured without fail.

However, since the support for the top plate is not directly provided, top plate 2 warps and results in insufficient cooling space in some cases.

Still more, since there is no sealing material between the bottom part of the cooker and cabinet 6, liquids that spill on the top plate passes through under cooker-supporting face 4, penetrates under the cooker which is inside cabinet 6, and may result in flooding inside cabinet 6.

The present invention solves the above disadvantages of the prior art, and provides a highly reliable cooker which satisfies both good cooling performance and features effective countermeasures against spilled liquids.

Furthermore, this cooker has a broad space on the top plate for easy cooking and easy cleaning.

SUMMARY OF THE INVENTION

A built-in cooker of the present invention includes a top plate, a support for supporting the top plate from below, a top frame covering the edge of the top plate and a frame constituting the cooker body. The support has a cooker-supporting face for supporting the cooker, and this is provided outside of a top plate-supporting face. A first opening is provided on at least one side wall provided between the top plate-supporting face and the cooker-supporting face. A second opening is provided on the frame in a position corresponding to the first opening at a predetermined distance.

DETAILED DESCRIPTION OF THE PREFERRED EMBODIMENTS

Figure 1:
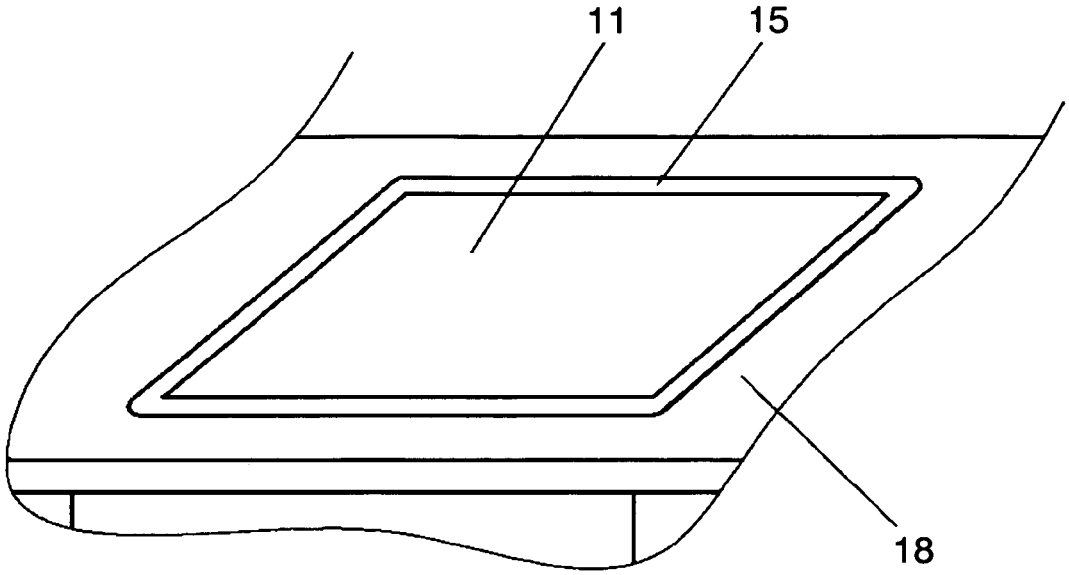
FIG. 1 is a perspective view of a cooker in accordance with a first exemplary embodiment of the present invention.
Figure 2:
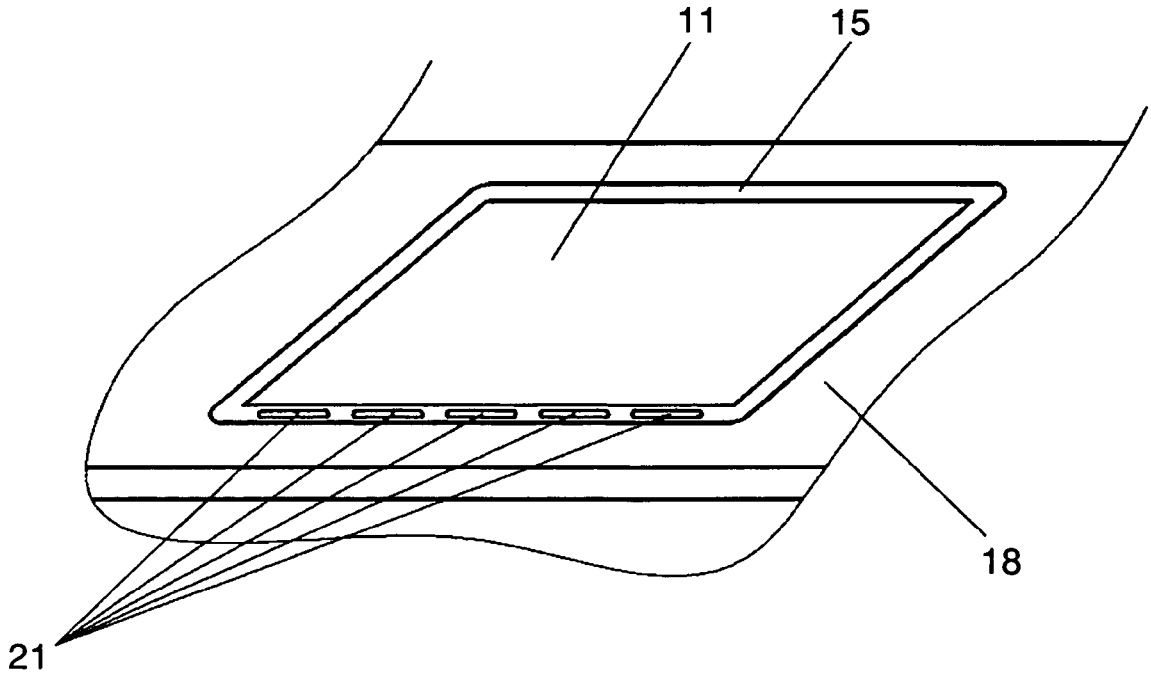
FIG. 2 is a perspective view of the cooker, seen from the back, in accordance with the first exemplary embodiment of the present invention.
Figure 3:
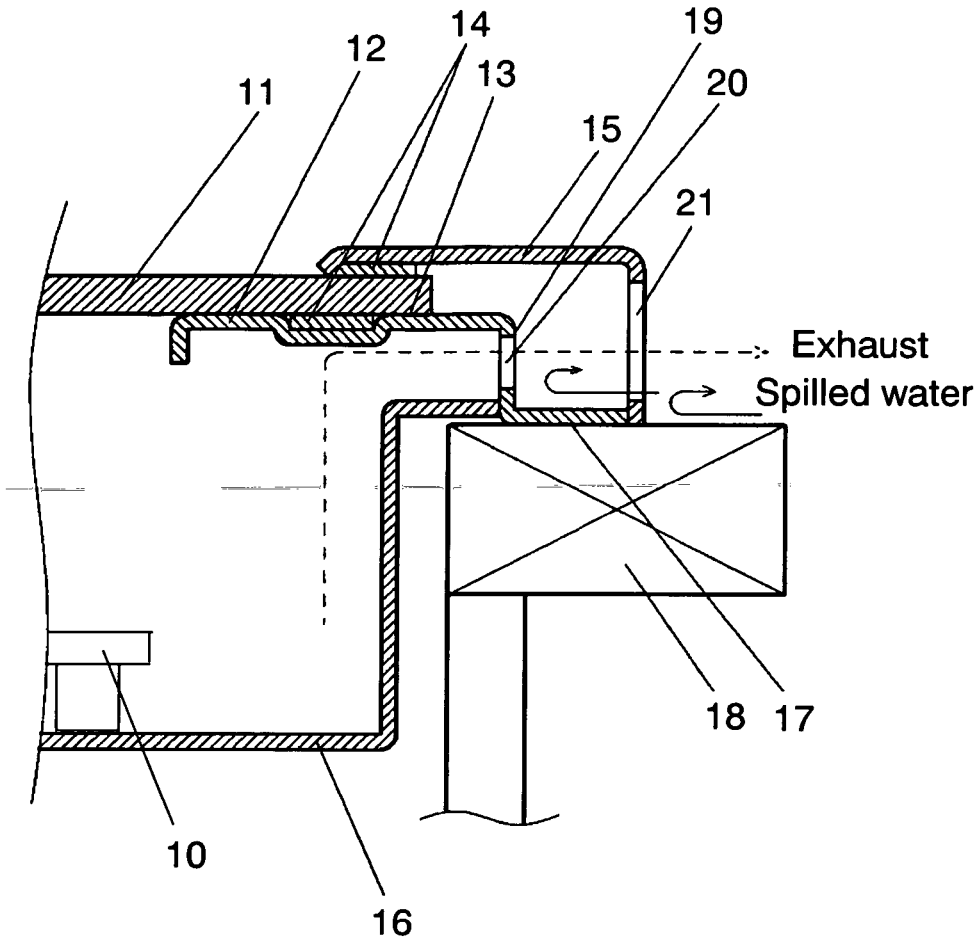
FIG. 3 is a detailed perspective view of the cooker, seen from the back, in accordance with the first exemplary embodiment of the present invention.
Figure 4:
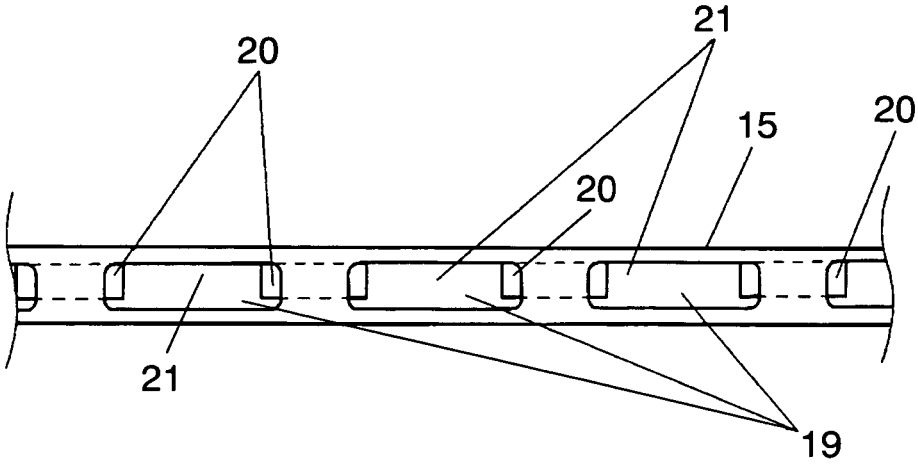
FIG. 4 is a detailed sectional view of the cooker, seen from the back, in accordance with the first exemplary embodiment of the present invention.

Exemplary embodiments of the present invention are described below with reference to drawings. The drawings are schematic views and thus do not accurately indicate dimensional positions. For reasons of simplicity, components with the same structure are given the same reference numerals. Curved arrows in the solid line in the drawings indicate the movement of spilled liquids or boiled-over soup.

The exemplary embodiments described hereafter do not limit the scope of the present invention.

First Exemplary Embodiment

A first exemplary embodiment is described below with reference to FIGS. 1 to 4.

As shown in FIGS. 1 to 4, top plate 11 where pots are placed is supported from underneath by top plate-supporting face 13 of support 12. Top plate 11 is typically made of a ceramic plate. Top plate 11 and top plate-supporting face 13 are fixed and bonded with heat-resistant adhesive 14. Top frame 15 is provided around the edge of top plate 11 so as to cover its periphery, and top plate 11 and top frame 15 are fixed with adhesive 14. Frame 16, constituting the cooker body, is provided inside support 12. Cooker-supporting face 17 is formed outside of top plate-supporting face 13, and the cooker is supported by placing this cooker-supporting face 17 on cabinet 18.

Side wall 19 is integrally formed between top plate-supporting face 13 and cooker-supporting face 17. Multiple first openings 20 are provided on the surface of side wall 19, configuring a path for letting air in and out to and from the cooker's internal space. In addition, second openings 21 are provided on top frame 15 in positions corresponding to first openings 20 with a predetermined distance (ex. 15 mm) in between, also configuring a path for letting air in and out.

The operation and function of the ventilation structure of the built-in heating cooker as configured above are described next.

In the above configuration, the case of spilling water over top plate 11 is examined. Most of the spilled water is blocked by top frame 15, but some water enters via second openings 21. Since there is a space of about 15 mm between first openings 20 and second openings 21, the water remains in the space between top frame 15 and support 12.

Naturally, some water penetrates further inside the cooker. However, side wall 19 blocks it, and almost no water enters into the cooker's internal space where live part 10 is located. The live part in this exemplary embodiment refers to a part not or not sufficiently electrically insulated. An example of the live part is a substrate unit on which electrical components are placed and electrically coupled on a printed wiring board. The live part is also present in drawings other than FIG. 3 but it is omitted for simplification.

As described above, ingress of water from outside is preventable by this simple structure that provides a predetermined space between first openings 20 and second openings 21.

In addition, support 12 contacts top plate 11 by top plate-supporting face 13, and also contacts cabinet 18 by cooker-supporting face 17 via side wall 19.

Since top plate 11 and pots are supported so as to fully secure a limited space between top plate 11 and cabinet 18, and the open area of first openings 20; the ventilation path is always open, achieving fully satisfactory cooling performance.

Water overflow into cabinet 18 is also preventable because cooker-supporting face 17 supports the cooker body and contacts cabinet 18.

Furthermore, top frame 15 constituting second openings 21 is not only a first impediment to water entering the cooker's internal space but also a protection covering top plate 11. Since the edge of the top plate 11 is hidden, no additional processing of full-edge treatment for preventing injuries by top plate 11 is needed, and an easy-to-clean top part is achieved. Still more, since second openings 21 are provided on a rear side face, the top surface is smooth without any holes. This offers an easy-to-clean cooker with a sleek design.

As described above, in the first exemplary embodiment, the cooker-supporting face is formed outside first openings 20 on the side wall of the support. In addition, the second openings are provided on the top frame in a position corresponding to the first openings, with a predetermined distance in between. This enables, by means of a simple structure, the prevention of liquids entering the cooker's internal space. In other words, this exemplary embodiment offers a highly reliable cooker both designed to cope with spilled liquids and with good cooling performance. The smooth top plate also achieves good design and easy cleaning.

Accordingly, the first exemplary embodiment achieves a thin top part (about 10 mm max.) and offers a structure that can secure the air vent for cooling inside the cooker on its top part.

This exemplary embodiment has an air inlet and outlet. However, the same effect is achievable with the structure only of the air inlet or outlet.

This exemplary embodiment also refers to one side at the back. However, the first openings and second openings can be provided on the back, and left and right sides. Still more, the same effect is achievable by providing the openings in different positions, such as only on the right side, depending on conditions, such as how the cooker is installed or the cooling system of the cooker. Furthermore, the same effect is achievable by making the bottom of the side wall against the top plate tilted obtusely outward (e.g., about 90 to 135°).

Second Exemplary Embodiment

A second exemplary embodiment is described below with reference to FIG. 5.

Figure 5:
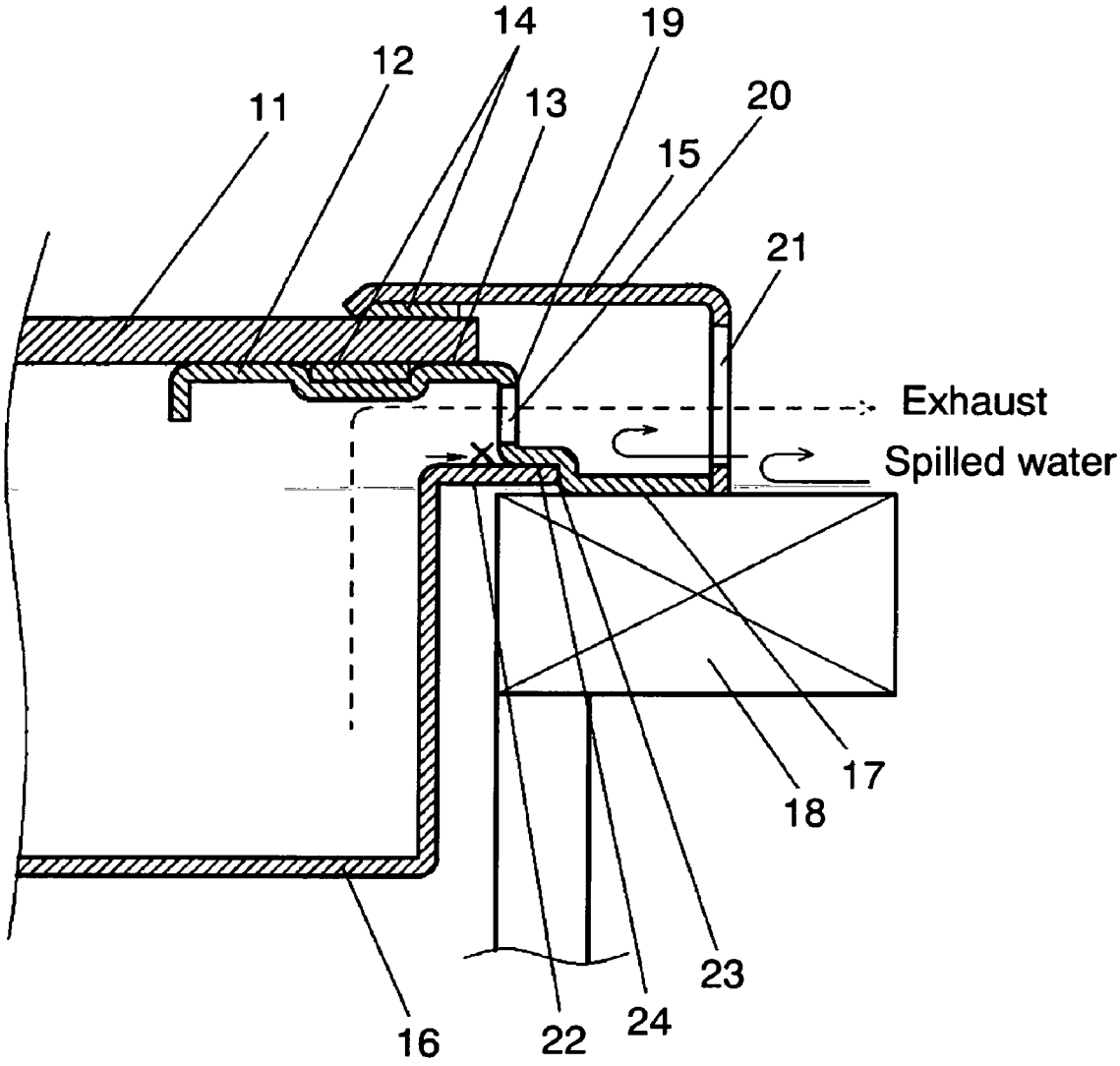
FIG. 5 is a detailed sectional view of a cooker, seen from the back, in accordance with a second exemplary embodiment of the present invention.

As shown in FIG. 5, the basic structure is the same as in the first exemplary embodiment, and thus only the structure different from the first exemplary embodiment is described.

Flange 22 is provided on the periphery of frame 16. Flange 22 is disposed over cabinet 18.

Side wall 19 of support 12 is located further inward towards the cooker's internal space than end 23 of flange 22. Flange 22 and frame-supporting face 24, provided between side wall 19 and cooker-supporting face 17, are in contact.

The operation and function of the ventilation structure of a built-in heating cooker as configured above is described next.

Also with respect to operation and function, only the parts different from the first exemplary embodiment are described.

The case of spilling water over top plate 11, and water further entering inside from first openings 20 is examined next. Water (indicated by 'X' in FIG. 5) entering from first openings 20 flows over flange 22. Since side wall 19 is placed on flange 22, and frame-supporting face 24 and flange 22 are in surface contact; water does not leak from frame-supporting face 24 and flange 22 to underneath flange 22. In addition, side wall 19 presses flange 22 downward, increasing the tightness of the seal.

As described above, the second exemplary embodiment provides a flange on the periphery of the frame, and the side wall of the support is disposed inner toward the cooker than the flange end. The flange and the outer frame-supporting face provided between the side wall and cooker-supporting face are in contact. This structure prevents leakage of water from the cooker to inside the cabinet, even if water enters from the first openings. A highly reliable cooker with significantly improved sealing capability can thus be offered. The sealing capability can be further improved by applying a sealing material between frame-supporting face 24 and flange 22.

It is apparent that the same effect as that described in the first exemplary embodiment is also achieved in the second exemplary embodiment.

Third Exemplary Embodiment

A third exemplary embodiment is described next with reference to FIG. 6.

Figure 6:
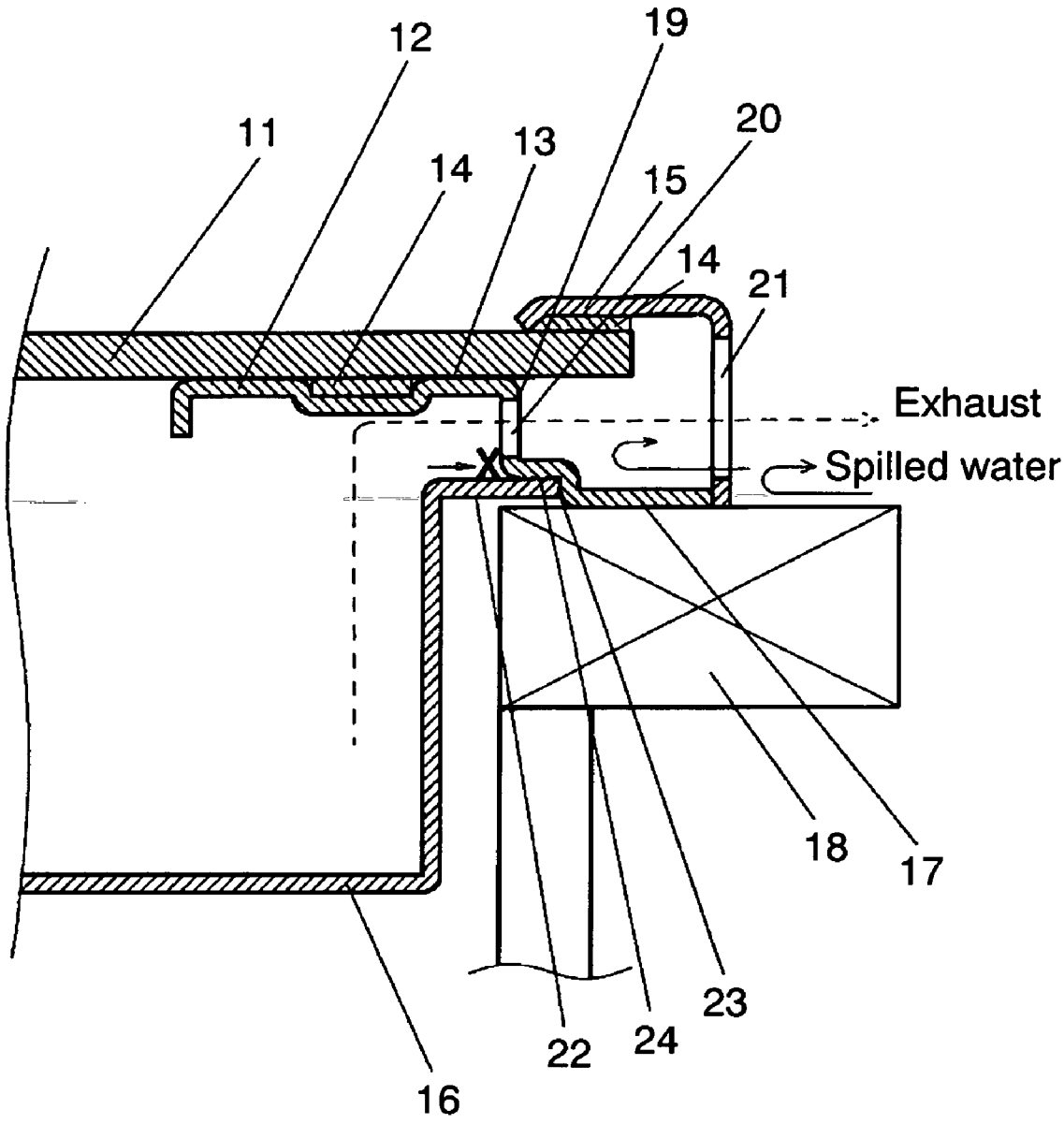
FIG. 6 is a detailed sectional view of a cooker, seen from the back, in accordance with a third exemplary embodiment of the present invention.

As shown in FIG. 6, the basic structure is the same as the second exemplary embodiment, and thus only the structure different from the second exemplary embodiment is described.

Side wall 19 is provided underneath top plate 11.

The operation and effect of the ventilation structure of the cooker as configured above is described next.

Also for the operation and function, only the parts different from the second exemplary embodiment are described.

Side wall 19 having first openings 20 is located underneath top plate 11. This enables the securing of space between top plate 11 and flange 22. In other words, the ventilation path can be fully secured. Accordingly, both good cooling performance and countermeasures against spilled liquids are achieved.

In addition, side wall 19 is disposed under top plate 11. This means that cooker-supporting face 17 can be positioned further inward towards the cooker's internal space. This allows shortening of the width of top frame 15 covering top plate 11 and supporting plate 12. Consequently, the area of top plate 11, which is the cooking area, can be made broader. Still more, since second openings 21, which are originally air vents, are not provided on the top face, the cooking area can be yet further broadened. Still more, a smooth surface without any holes makes cleaning extremely easy and gives a neat appearance. There is a slight gap between top frame 15 and top plate 11, and the top frame is higher. This gap acts as a stopper for the pot in use if the pot deviates and moves to the end of the top part, preventing the pot from falling. Thus, safety is also improved.

As described above, the third exemplary embodiment has the side wall underneath the top plate. This assures good cooling performance by fully securing the ventilation path between the top plate and support, as well as countermeasures against spilled liquids, offering a highly reliable cooker. Furthermore, this exemplary embodiment offers an easy-to-cook, easy-to-clean, high-safety and easy-to-use cooker with a broad top plate.

It is apparent that the same effect as that described in the first exemplary embodiment is also achieved in the third exemplary embodiment.

Fourth Exemplary Embodiment

A fourth exemplary embodiment is described next with reference to FIG. 7.

Figure 7:
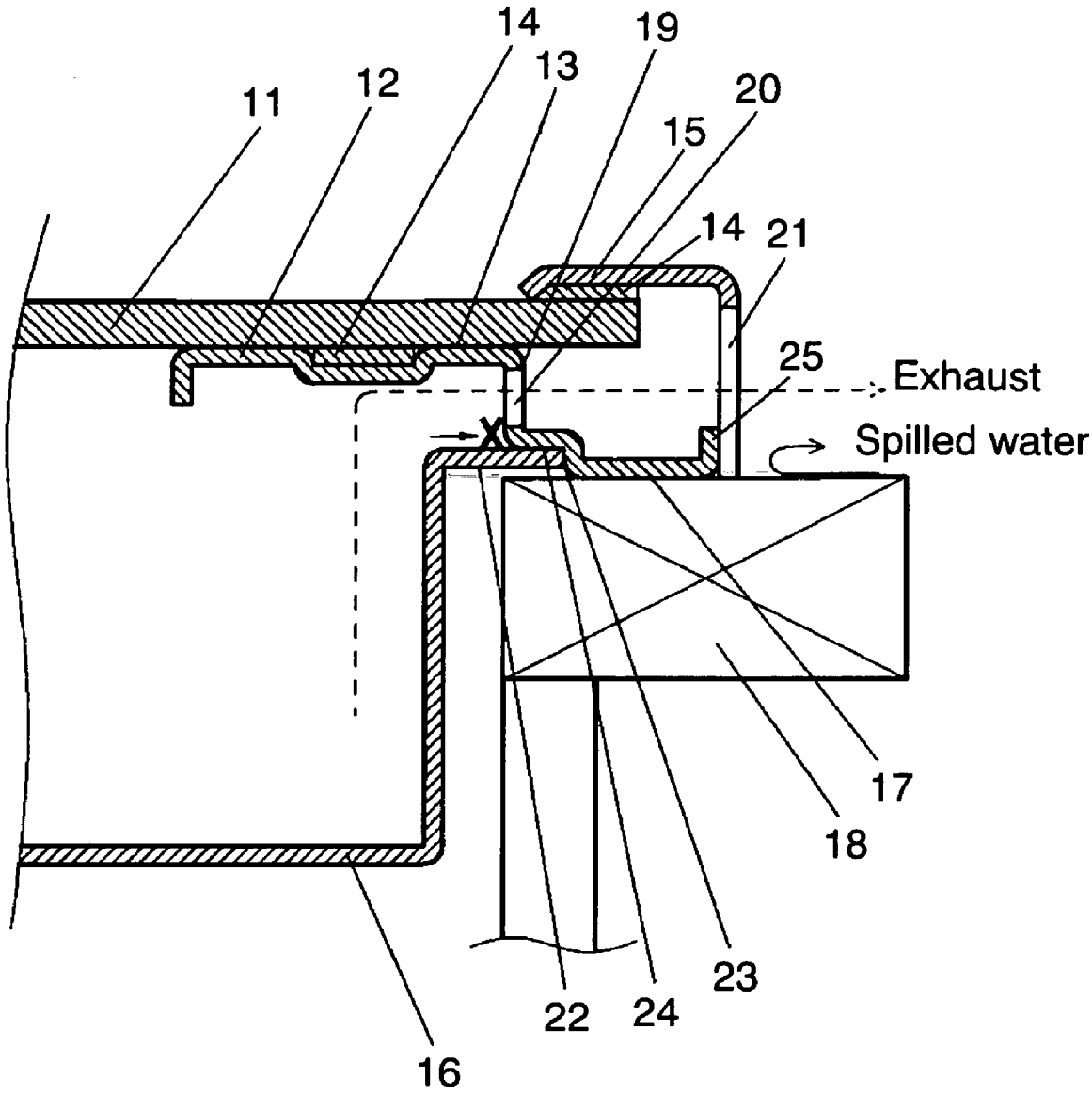
FIG. 7 is a detailed sectional view of a cooker in accordance with a fourth exemplary embodiment of the present invention.

As shown in FIG. 7, the basic structure is the same as in the third exemplary embodiment, and thus only the structure different from the third exemplary embodiment is described.

Wall 25 is integrally provided with support 12 on the periphery of cooker-supporting face 17 of support 12.

The operation and function of the ventilation structure of the built-in heating cooker as configured above is described next.

Also with respect to operation and function, only the parts different from the third exemplary embodiment are described.

The case of spilling water over top plate 11 is examined. Second openings 21 are provided on top frame 15. Second openings 21 can be extended even to the face contacting cabinet 18. However, wall 25 is provided on the entire periphery of cooker-supporting face 17 of support 12.

Consequently, wall 25 blocks ingress of water on cabinet 18 and in through second openings 21, and amount of water entering inside top frame 15 can be significantly reduced.

In addition, since wall 25 is processed by bending the rim of support 12, the strength of support 12 can be sufficiently secured.

Accordingly, the third exemplary embodiment blocks water from entering inside the cooker body from the first. Countermeasures against spilled liquids and good cooling performance are thus both achievable.

As described above, this exemplary embodiment provides the wall on the periphery of the cooker-supporting face. This offers a highly reliable cooker with further protection for ingress of spilled liquids. It is also apparent that the same effect as that described in the first exemplary embodiment is also achieved.

In the above description, the wall is integrally made with the support. The same effect is also achievable by the use of a separate component for the wall.

Fifth Exemplary Embodiment

A fifth exemplary embodiment is described with reference to FIG. 8.

Figure 8:
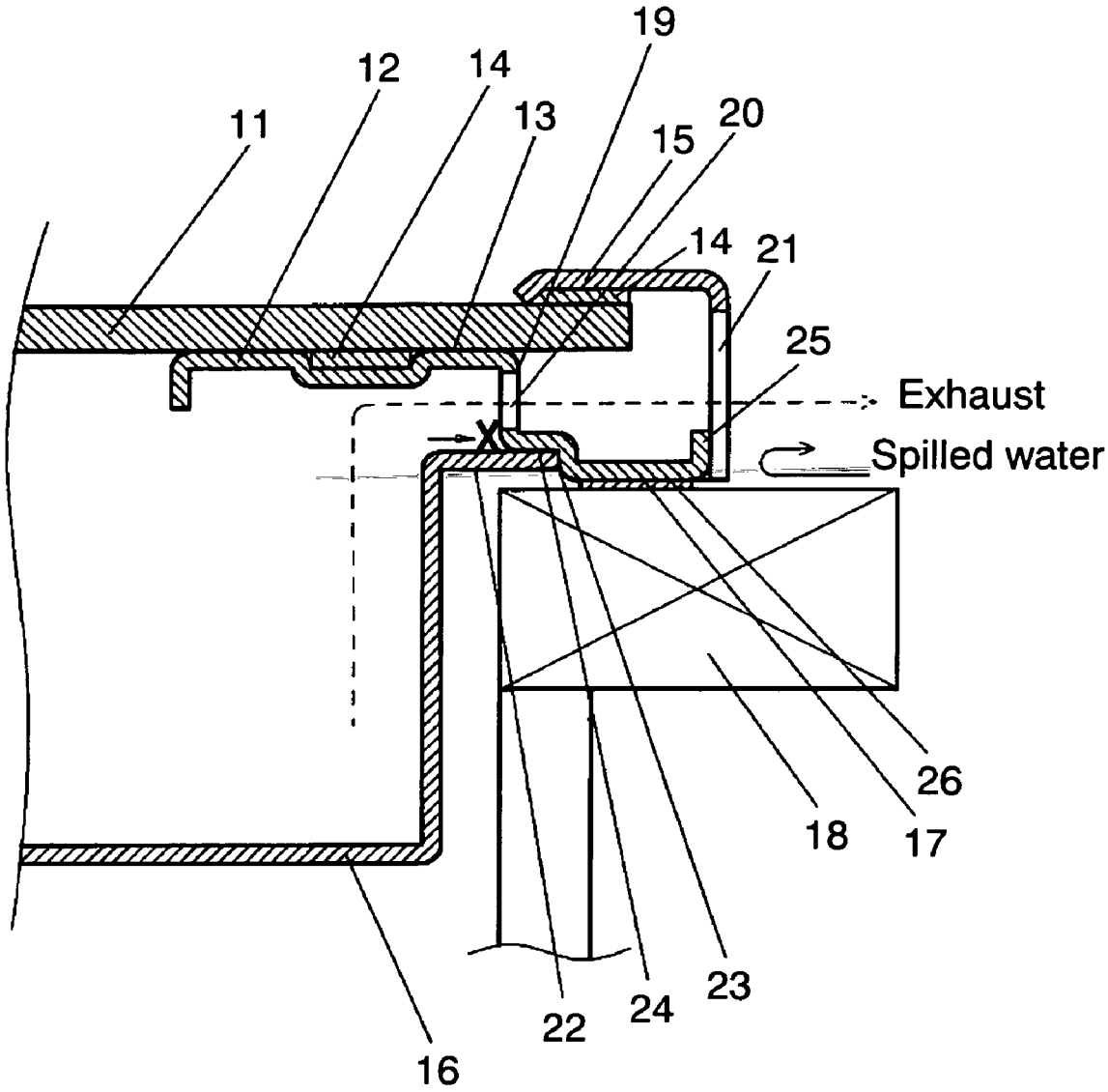
FIG. 8 is a detailed sectional view of a cooker, seen from the back, in accordance with a fifth exemplary embodiment of the present invention.

As shown in FIG. 8, the basic structure is the same as in the fourth exemplary embodiment, and thus only the structure different from the fourth exemplary embodiment is described.

Sealing material 26 is provided underneath cooker-supporting face 17 of support 12.

The operation and function of the ventilation structure of a built-in heating cooker as configured above is described next.

Also with respect to operation and function, only the parts different from the fourth exemplary embodiment are described.

The case of spilling water over top plate 11 is examined.

Water flows toward the cooker body. However, since sealing material 26 is provided on the entire circumference underneath cooker-supporting face 17, water does not enter from between the cooker body and cabinet 18. This significantly improves countermeasures against ingress of spilled liquids to inside cabinet 18.

Sealing material 26 can be provided typically by applying silicone foam or a sealing tape. Any other means with sealing effect are applicable.

As described above, the fifth exemplary embodiment applies the sealing material on the entire circumference underneath the cooker-supporting face. This offers a highly-reliable and easy-to-use cooker preventing ingress of water to inside the cabinet.

Sixth Exemplary Embodiment

A sixth exemplary embodiment of the present invention is described with reference to FIGS. 9A, 9B and 10.

Figure 9A:
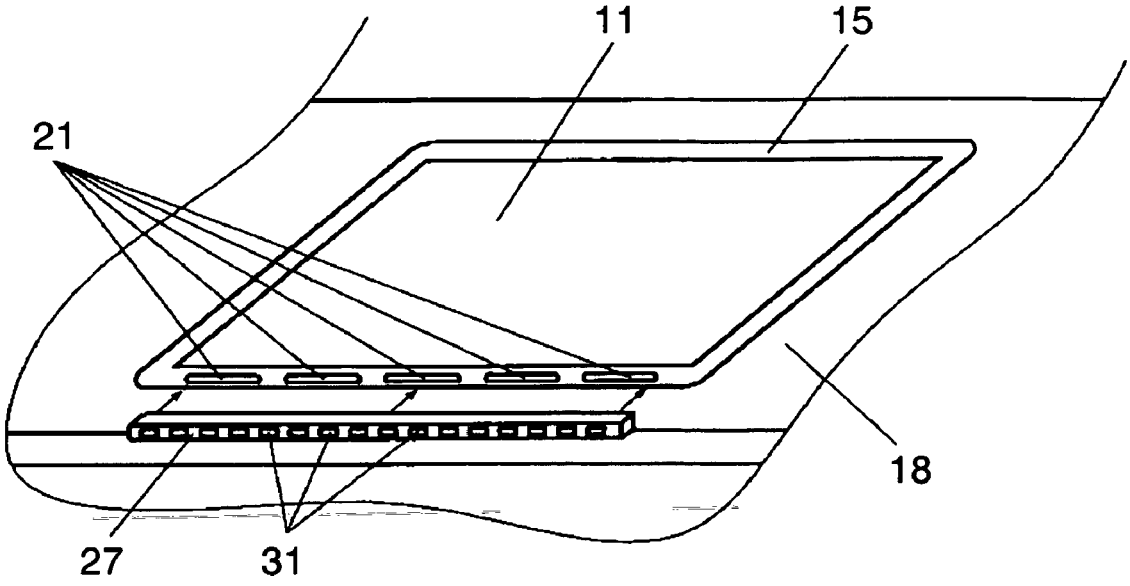
FIG. 9A is a perspective view of the cooker (without cover), seen from the back, in accordance with the sixth exemplary embodiment of the present invention.
Figure 9B:
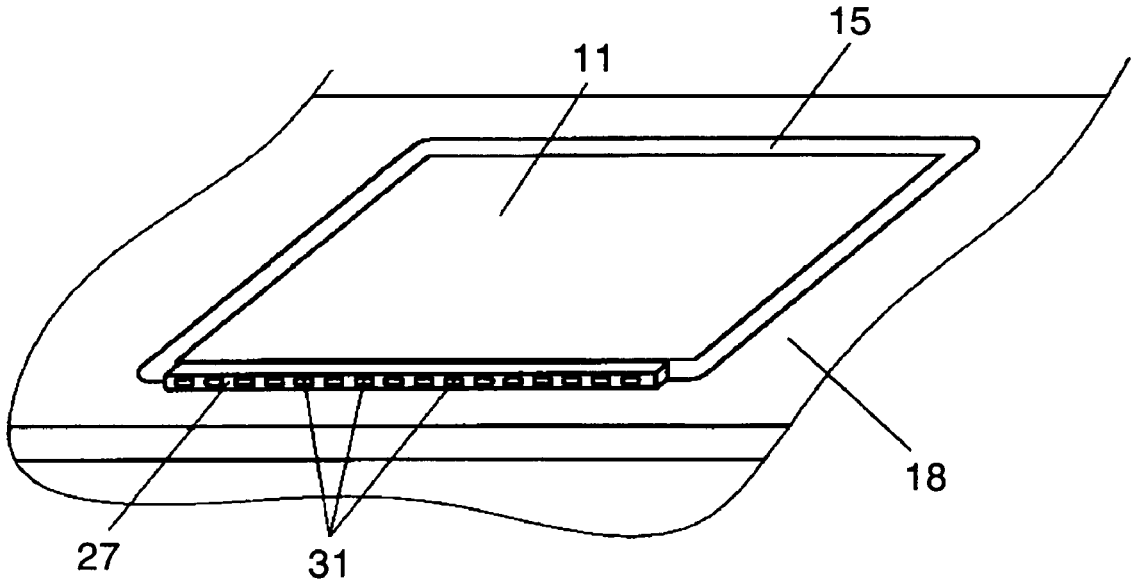
FIG. 9B is a perspective view of the cooker (with cover), seen from the back, in accordance with the sixth exemplary embodiment of the present invention.
Figure 10:
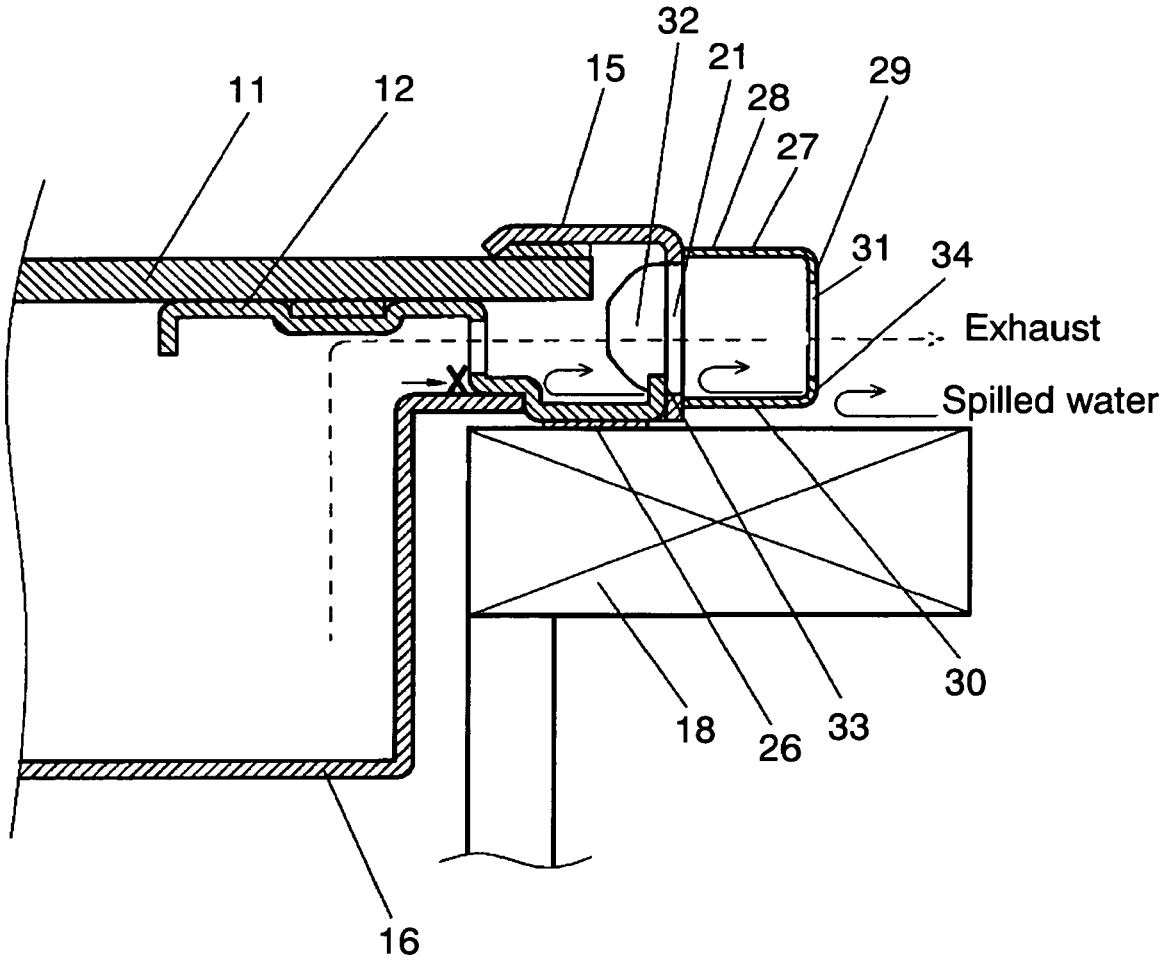
FIG. 10 is a detailed rear sectional view of the cooker, seen from the back, in accordance with the sixth exemplary embodiment of the present invention.
Figure 11:
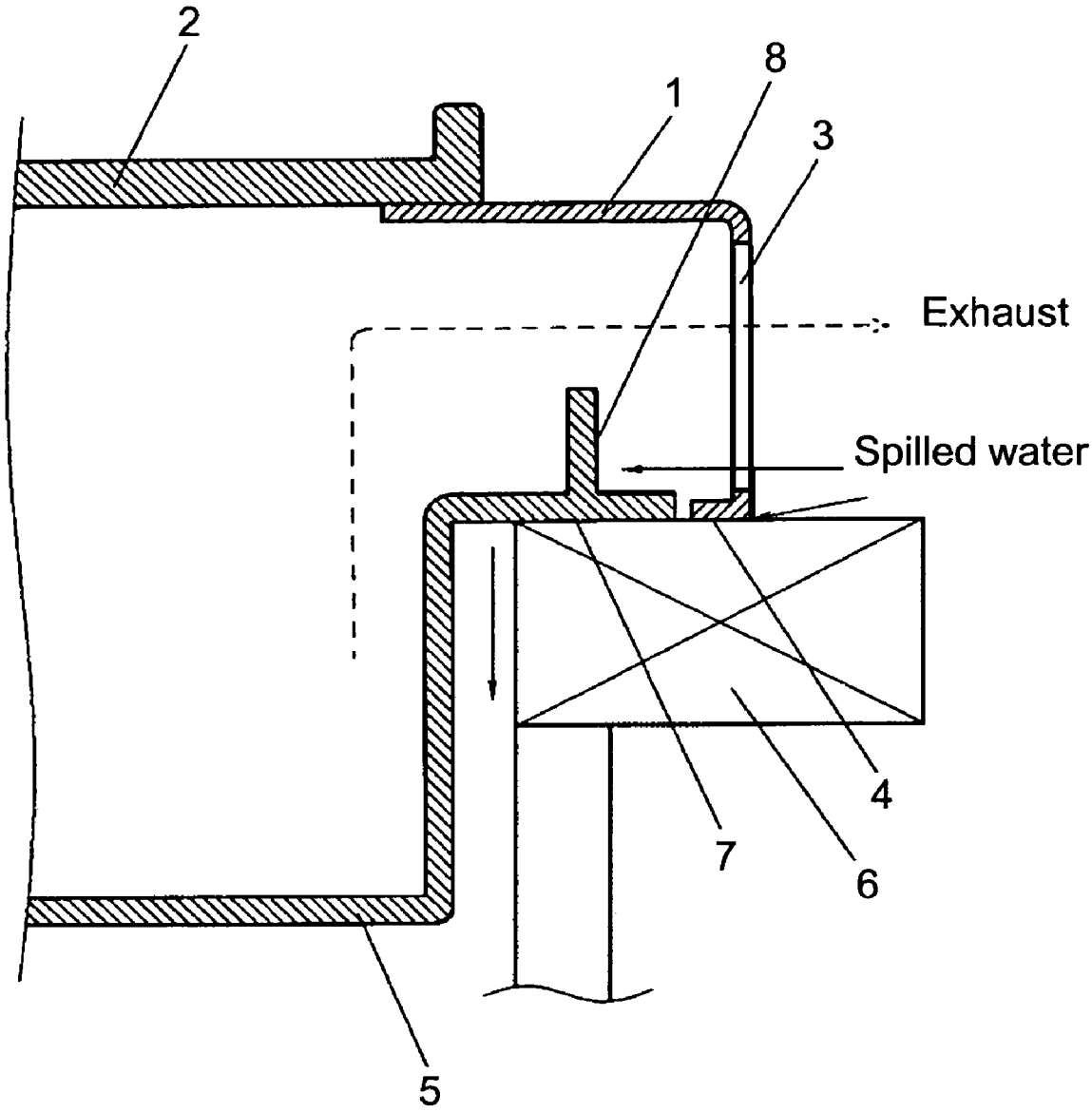
FIG. 11 PRIOR ART
FIG. 11 is a detailed sectional view, seen from the back, of a conventional cooker.

As shown in FIGS. 9A, 9B and 10, the basic structure is the same as the fifth exemplary embodiment, and thus only the structure that is different is described below.

Cover 27 is attached to the side face of top frame 15 in a way such as to cover second openings 21. Cover 27 includes top face 28, cover side wall 29 and bottom face 30. Cover side wall 29 has multiple third openings 31, and elastic member 32 with spring force is provided at both its ends. Cover 27 is detachably mounted on top frame 15 by fitting this elastic member 32 to both ends of the second openings. Both second openings 21 and third openings 31 are provided on the side face over first side face 33 and second side face 34 disposed from the bottom end of top frame 15 and cover 27 respectively.

With respect to cooling structure, the air cooling the cooker's internal space passes between frame 16 and top frame 15, first openings 20, second openings 21, cover 27 and third openings 31, then exits the cooker.

The operation and function of the ventilation structure of the cooker as configured above are described next.

Also for the operation and function, only the parts different from the fifth exemplary embodiment are described.

First, the case of boiled-over soup that pools at the back of top plate 11 in the above structure is examined. Boiled-over soup drips down cover top face 28 to cabinet 18. However, it does not enter inside cover 27 because cover 27 is attached to the back of top frame 15 and there is no opening on top face 28.

Even if a large volume of boiled-over soup drips onto cover 27, the flow of boiled-over soup on cabinet 18 mostly blocked by cover side wall 29 and second side wall 34 on the same face. Consequently, only a little enters inside cover 27. However, since third openings 31 for cooling inside the cooker are provided, a certain amount of boiled-over soup enters them. The boiled-over soup passing through third openings 31 is pooled in a space inside cover 27, and thus it does not yet enter inside the cooker.

The boiled-over soup still reaching further inside is blocked by the side face of top frame 15 and wall face A33, and thus hardly any enters inside the cooker. It is preferable that second openings 21 and third openings 31 are disposed alternately, as seen from the back. In this way, a structure that further prevents entrance of boiled-over soup is established, although ventilation becomes slightly less efficient.

Since cover 27 is detachable, it can be easily removed and cleaned. In other words, even when third openings 31, which are the air vents, are stained and clogged with boiled-over soup, etc., detachable cover 27 can be easily removed and cleaned to keep cover 27 clean and thus maintain the original performance.

A detachable system is made feasible by providing elastic member 32 with spring force at both sides of cover 27. Cover 27 is attachable to and detachable from top frame 15 just by pushing and pulling, although it is at the back where attachment is difficult.

In addition, the spring structure allows firm attachment without a gap, although the side face lacks stability.

As described above, the sixth exemplary embodiment offers a structure that makes it difficult for boiled-over soup to enter the cooker and also secures good cooling performance. In addition, the cover is easily detachable for cleaning. Accordingly, this exemplary embodiment offers a highly reliable cooker with easy cleaning and easy attachment.

Elastic member 32 can be integrally made with cover 27, or separately made and fixed to cover 27 by spot welding, screwing, etc. Common elastic members are usable as material for elastic member 32.

With respect to the detachable system, any detachable means is applicable.

For example, a leaf spring is provided inside the top, and the face with cover can be sandwiched and fixed between the leaf spring and the top face. Or, if the top and cover are made of magnetic material, a magnet can be provided on both or either part. Alternatively, a tab with a spring structure can be hooked to the top, and detached by a single touch.

Alternatively, a protrusion can be made on a resin member fixed to the cover, and this is press-fitted to the second openings as a detachable mechanism.

Next, the characteristics of the present invention are summarized as below.

The cooker of the present invention includes the top plate; the support supporting the top plate from underneath; the top frame covering the edge of the top plate; and the frame constituting the cooker body. The support has a cooker-supporting face for supporting the cooker outside of the top plate-supporting face. The first openings are provided on at least one side wall between the top plate-supporting face and cooker-supporting face. The second openings are provided on the top frame at positions corresponding to the first openings at a predetermined distance. This structure readily secures the space in the top frame, reduces ingress of water to the cooker's internal space, and secures the cooling path. The present invention thus offers a highly reliable cooker with good cooling performance.

Still more, the cooker of the present invention provides a flange on the periphery of the frame, and the side wall of the support is positioned further inward of the cooker body than the flange end. In addition, the flange and the frame-supporting face provided between the side wall and the cooker-supporting face are in contact. This offers a highly reliable cooker with further improved sealing against leakage of water between the cooker and cabinet to the inside of the cooker.

Still more, the cooker of the present invention has a side wall underneath the top plate. This enables the side wall to directly support the top plate, and thus the ventilation path between the top plate and support is fully secured. More specifically, a highly reliable cooker with both countermeasures against spilled liquids and good cooling performance are made feasible. Still more, disposition of the cooker-supporting face inward of the cooker body reduces the width of the top frame covering the top plate and supporting plate. Consequently, a broader top plate area offers a user-friendly cooker that has superior working space for cooking and affords easy cleaning.

Moreover, the cooker of the present invention has a wall on the periphery of the cooker-supporting face. This reduces the risk of water dripping on the cabinet through the second openings to inside the cooker, offering high reliability.

Furthermore, the cooker of the present invention is provided with sealing material on the entire circumference of the bottom of the cooker-supporting face. This prevents entrance of water passing underneath the cooker-supporting face to underneath the cooker bottom, which is inside the cabinet. Accordingly, a highly reliable and easy-to-use cooker is made feasible.

The built-in heating cooker of the present invention has an air vent on the top part, and has a cooker-supporting face outside the first openings provided on the side wall of the support and the second openings on the top frame in positions corresponding to the first openings at a predetermined distance. This allows the entry of water inside the cooker to be prevented by means of a simple structure. In addition, provision of a top frame broadens the space on the top plate, offering a safe and easy-to-clean cooker that has superior working space for cooking with much reduced risk of pots sliding off. Moreover, the provision of openings at the rear side face slims the top part (by about 10 mm) that appears on the cabinet, and also achieves a smooth and flat top plate without any holes. Accordingly, the present invention also offers a cooker with a sleek design in addition to good cooling performance and features effective countermeasures against spilled liquids.

INDUSTRIAL APPLICABILITY

The built-in heating cooker of the present invention has a ventilation structure that both features effective countermeasures against spilled liquids and good cooling performance. Accordingly, the cooker of the present invention is applicable for use typically in apparatuses having air vents near liquids (e.g., cooking appliances, household appliances) and built-in appliances which may be exposed to spilled water.

The invention claimed is:

1. A built-in heating cooker comprising:

a top plate;

a support supporting the top plate from underneath, the support including a top plate-supporting face contacting the top plate, and a cooker-supporting face contacting a cabinet;

a top frame covering an edge of the top plate; and a frame constituting a cooker body, the frame having a flange disposed over the cabinet;

wherein the support has the cooker-supporting face, the cooker-supporting face being positioned outside of the top plate-supporting face and the flange;

a first opening is provided on at least one side wall disposed between the top plate-supporting face and the cooker-supporting face; and a second opening is provided on the top frame in a position corresponding to the first opening at a predetermined distance.

2. The built-in heating cooker as defined in claim 1, wherein a sealing material is applied on an entire circumference of a bottom face of the cooker-supporting face of the support.

3. The built-in heating cooker as defined in claim 1, wherein a wall is provided on a periphery of the cooker-supporting face of the support.

4. The built-in heating cooker as defined in claim 3, wherein a sealing material is applied on an entire circumference of a bottom face of the cooker-supporting face of the support.

5. The built-in heating cooker as defined in claim 1, wherein the side wall is provided underneath the top plate.

6. The built-in heating cooker as defined in claim 5, wherein a sealing material is applied on an entire circumference of a bottom face of the cooker-supporting face of the support.

7. The built-in heating cooker as defined in claim 5, wherein a wall is provided on a periphery of the cooker-supporting face of the support.

8. The built-in heating cooker as defined in claim 7, wherein a sealing material is applied on an entire circumference of a bottom face of the cooker-supporting face of the support.

9. The built-in heating cooker as defined in claim 1, wherein the flange is provided on a periphery of the frame;

the side wall of the support is positioned further inward of the cooker body than the flange end; and the flange and a frame-supporting face provided between the side wall and the cooker-supporting face are in contact.

10. The built-in heating cooker as defined in claim 9, wherein a sealing material is applied on an entire circumference of a bottom face of the cooker-supporting face of the support.

11. The built-in heating cooker as defined in claim 9, wherein a wall is provided on a periphery of the cooker-supporting face of the support.

12. The built-in heating cooker as defined in claim 11, wherein a sealing material is applied on an entire circumference of a bottom face of the cooker-supporting face of the support.

13. The built-in heating cooker as defined in claim 9, wherein the side wall is provided underneath the top plate.

14. The built-in heating cooker as defined in claim 13 wherein a sealing material is applied on an entire circumference of a bottom face of the cooker-supporting face of the support.

15. The built-in heating cooker as defined in claim 13, wherein a wall is provided on a periphery of the cooker-supporting face of the support.

16. The built-in heating cooker as defined in claim 15, wherein a sealing material is applied on an entire circumference of a bottom face of the cooker-supporting face of the support.

* * * * *